United States Patent [19]

Wirt

[11] 4,303,520

[45] * Dec. 1, 1981

[54] SURFACE EXTRACTION APPARATUS

[75] Inventor: Leslie S. Wirt, Newhall, Calif.

[73] Assignee: Lockheed Corporation, Burbank, Calif.

[ * ] Notice: The portion of the term of this patent subsequent to May 8, 1996, has been disclaimed.

[21] Appl. No.: 163,880

[22] Filed: Jun. 27, 1980

[51] Int. Cl.[3] ..... E02B 15/04

[52] U.S. Cl. ..... 210/242.1; 60/398; 210/923; 415/7

[58] Field of Search ..... 210/242, 923; 60/398; 415/7; 290/42, 43, 53, 54

[56] References Cited

U.S. PATENT DOCUMENTS

| | | | |
|---|---|---|---|
| 3,722,688 | 3/1973 | Wirachy | 210/923 |
| 3,722,689 | 3/1973 | Martel et al. | 210/923 |
| 3,753,496 | 8/1973 | Boyd | 210/923 |
| 3,753,497 | 8/1973 | Hoffman | 210/923 |
| 3,762,548 | 10/1973 | McCabe | 210/923 |
| 3,836,004 | 9/1974 | Fauret | 210/923 |
| 3,853,767 | 12/1974 | Mohn | 210/923 |
| 3,853,768 | 12/1974 | Bagnulo | 210/923 |
| 4,152,895 | 5/1979 | Wirt | 60/398 |

*Primary Examiner*—Theodore A. Granger
*Attorney, Agent, or Firm*—Frederic P. Smith; John J. Morrissey; Billy G. Corber

[57] ABSTRACT

Apparatus for extracting material floating on the surface of a fluid having waves thereon is provided comprising means (20) for causing the waves to break, means (36) for directing the broken waves to induce a downward flow of surface fluid and the material thereon, means (34) for discharging the downward flow of fluid and said material a preselected distance below the surface of the fluid, and means (20, 22) for containing the discharged material. In a particular embodiment, a submerged refractive structure in the form of a dome-shaped shell (20) is provided to cause the waves to break. Guide vanes (36) direct the broken surface waves into a centrally disposed vertical standpipe (34) where the fluid and the entrained floating material flows downward and is then discharged at the bottom of the shell. The material accumulates at the upper interior portion (22) within the shell. An access opening (50) is provided through the wall of the shell to facilitate removal of the material accumulated within the shell.

2 Claims, 4 Drawing Figures

SURFACE EXTRACTION APPARATUS

TECHNICAL FIELD

The invention relates to the field of debris collection and, in particular, to apparatus for removing floating material from the surface of a fluid.

BACKGROUND

This invention is an improvement of the apparatus shown and described in U.S. Pat. No. 4,152,895, issued May 8, 1979, entitled Wave Powered Motor, by the present inventor and assigned to the assignee hereof, the disclosure of which is incorporated herein by reference.

The structure described in the aforementioned prior patent employs a dome-shaped shell which may be floated in a partially submerged condition within the open sea, with the open mouth of the shell nearest the floor. This prior structure causes the surface waves to break and captures these waves by directing such breaking waves into a vertical standpipe centrally disposed within the shell. Inlet guide vanes impart a rotational motion to the water entering the standpipe. The water within the standpipe flows vertically downward with a vortex motion and is discharged through a diffuser in the area of the open mouth at the base of the shell. The energy of the waves is extracted by placing a turbine rotor within the flow in the standpipe.

Although the structure of this prior invention is very useful in extracting wave energy, it has been found that this prior structure can be adapted to the efficient extraction of floating material. Floating material basically comprises salvageable material and discardable material. One example of salvageable material is oil which, as is well known, is becoming an ever-increasing problem on the surface of the sea. Examples of discardable floatable material are organic matter (dead fish, jetsam and the like) and inorganic matter (such as empty bottles, cans, and the like).

It is, therefore, a general object of the present invention to provide a novel and improved structure for the extraction of floating material.

It is another object of the present invention to provide a novel and improved structure for the extraction of floating material which is partially submerged in the sea.

It is another object of the present invention to provide a novel and improved structure for the extraction of floating material, which structure also converts wave energy into useful work.

DISCLOSURE OF INVENTION

Apparatus for extracting material floating on the surface of a fluid having waves thereon is provided comprising means for causing the waves to break, means for directing the breaking waves to induce a downward flow of surface fluid and the material thereon, means for discharging the downward flow of fluid and the material a preselected distance below the surface of the fluid, and means for containing the discharged material.

In a particular embodiment, an upwardly convex, dome-shaped shell is employed which is submerged just beneath the sea surface and causes the waves to break. The shell is open at the bottom and has a centrally located inlet opening to which is coupled a vertical cylindrical standpipe. Located about the inlet opening is an annular array of inlet guide vanes which direct the breaking waves into the standpipe. The exterior surface of the shell utilizes refraction, due to Fermat's Principle, for concentrating incident wave energy wherein waves, although not directly aimed at the inlet opening but adjacent thereto, are drawn into the inlet opening. By this means, a substantially greater quantity of water is caused to enter the vertical standpipe than would otherwise occur. The fluid and the entrained floating material, after passing downwardly through the standpipe, are discharged at the open bottom of the shell. The material will accumulate at the upper interior portion of the shell and can be removed through an access opening provided through the shell.

Many other advantages, features and additional objects of the present invention will become manifest to those versed in the art upon making reference to the detailed description and the accompanying sheets of drawings in which various structural embodiments incorporating the principles of the invention are shown by way of illustrative examples. It is to be expressly understood, however, that the drawings are for purposes of illustration and description only and are not intended as a definition of the limits of the invention.

BEST MODE FOR CARRYING OUT THE INVENTION

Figure 1:
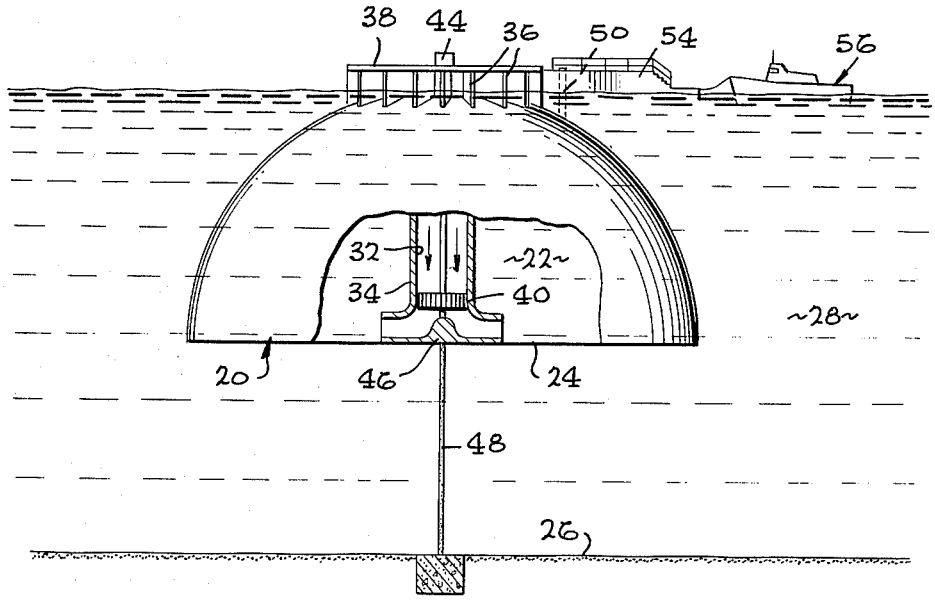
FIG. 1 is a partial cross-section side view, diagrammatically illustrating a first embodiment of the surface extraction apparatus of the present invention.
Figure 2:
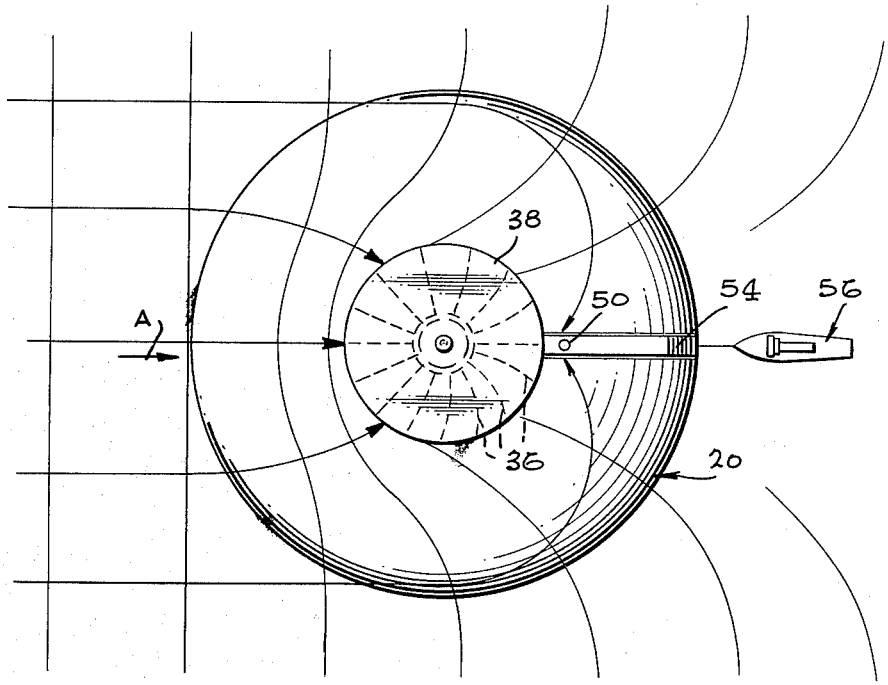
FIG. 2 is a top plan view of the apparatus of FIG. 1.

Referring now to FIGS. 1 and 2, a first embodiment of the surface extraction apparatus of the invention is illustrated which takes the shape of a dome-shaped shell 20, which is typically 200–300 feet in diameter. The dome-shaped shell 20 includes a large interior chamber 22, with the open mouth 24 of the chamber 22 being located nearest the floor 26 of the sea 28. The exterior surface of the shell 20 forms an upwardly convex structure when in position within the sea 28, with the apex thereof of the shell 20 being at or below the surface of the sea 28. The shell 20 includes an inlet opening 30 which is centrally located at the apex of the shell 20. The inlet opening 30 connects with an elongated vertical passage 32 formed by a vertical standpipe 34. Fixedly secured to the exterior surface of the shell 20 and located about the inlet opening 30 are a plurality of inlet guide vanes 36. The upper ends of the inlet guide vanes 36 are connected together by a plate 38.

The inlet guide vanes 36 extend initially radially outward from the inlet opening 30, and then may assume preselected arcuate configurations depending on whether they are to receive waves omnidirectionally or whether they are to receive the overall wave direction as noted by arrow A of FIG. 2. The exterior configuration of the dome-shaped shell 20 causes the waves to bend in their direction and enter between the inlet guide vanes 36 from the sides and even from the rear, as is shown in FIG. 2 by the depicted wave grid pattern. This bending of the waves is due to refraction caused by the exterior surface contour of the dome-shaped shell 20, the refraction being based, as stated previously, on Fermat's Principle. When the shell 20 is oriented in a preselected direction, as described hereafter, each inlet guide vane 36 is designed for a specific location based on from what direction the guide vane is to receive the wave. In other words, if the guide vane is to receive the wave directly, the guide vane has a certain basic configuration as is shown by the guide vanes 36 which are located nearest arrow A. The guide vanes which are to receive the wave from the side have a different base configuration. The guide vanes 36 located on the lee side (the side diametrically opposite arrow A) have a still different basic configuration. In any event, the basic configuration of the guide vanes 36 is determined by the ray path shape to minimize energy loss in the conducting of the wave into the inlet opening 30.

Each adjacent pair of guide vanes 36 functions to create a channel or path for the water to be conducted therethrough and discharged into the inlet opening 30. The water flows downward through the passage 32 and is discharged beneath the chamber 22. A turbine 40 coupled to a shaft 42 and a load device 44, such as a generator, and a diffuser 46 are illustrated but are not used in the present invention for their primary purpose of generating electric power as in the invention described and claimed in the aforementioned U.S. Pat. No. 4,152,895.

The structure shown in FIGS. 1 and 2 is free-floating and is tethered by tether line 48 which is secured to the floor 26 of the sea 28. Since the tether line 48 is coupled to the diffuser 46, or to the standpipe 34 where no diffuser is used, the shell 20 is free to pivot around the tether line 48 and assume a random orientation with respect to the direction of movement of the waves. As such, inlet guide vanes 36 would have an omnidirectional configuration. Located in the shell 20 is an access pipe 50 which is normally closed by cover 52. The pipe 50 and the cover 52 extend up through a floating walkway 54 which is attached to the shell 20 at plate 38. The walkway 54 serves as a mooring for ship 56 and provides access to cover 52.

Figure 3:
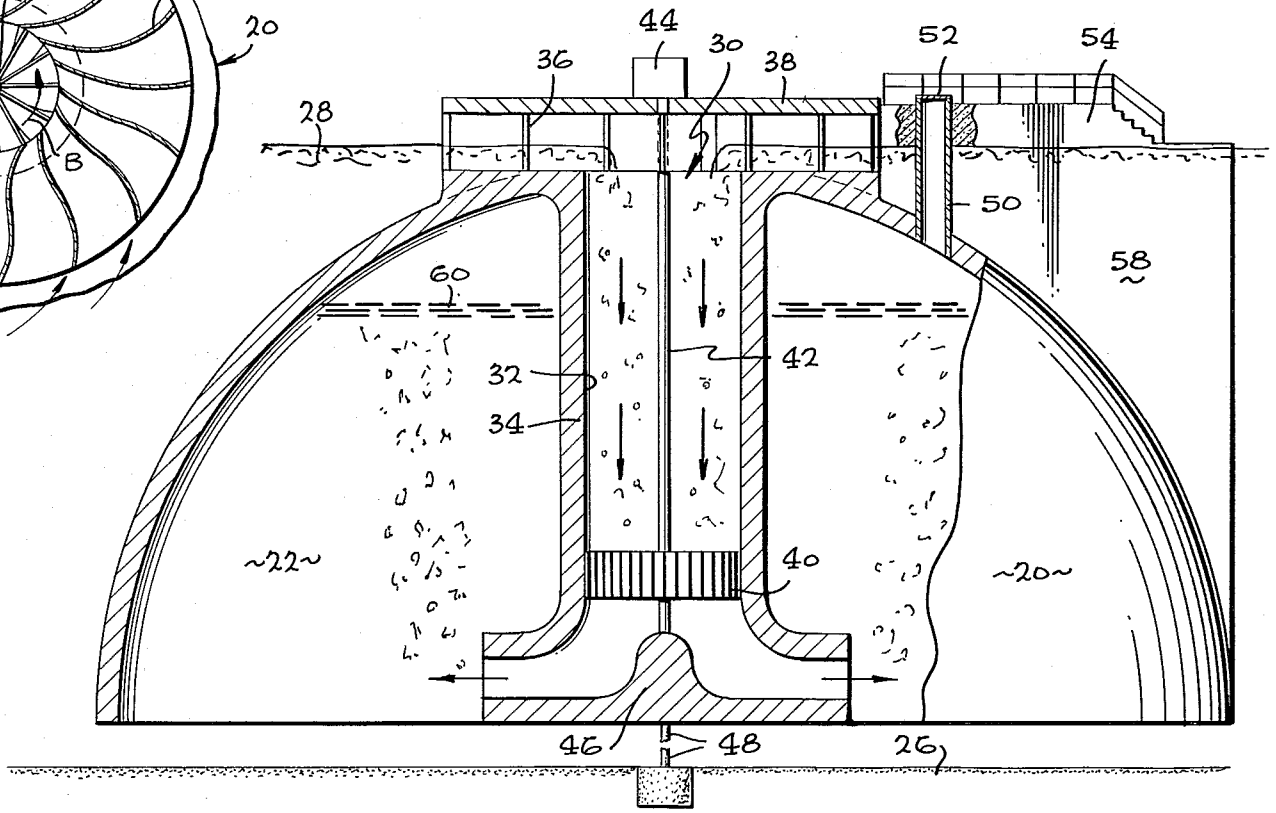
FIG. 3 is an enlarged view in partial cross-section of a modified version of the apparatus of FIG. 1 depicting more clearly the method of operation.

As shown in FIG. 3, material floating on top of the sea 28 is conducted between the vanes 36, down through the passage 32, and then discharged into the lower portion of the chamber 22. The material will rise and collect within the upper portion of the chamber 22, displacing sea water therefrom. The material can then be removed through the pipe 50 and the access port 52 either manually or by an evacuation pump or other such similar means reaching into the chamber 22. In this way refuse, such as containers, wood and the like, or savable material, such as crude oil 60 which has been spilled onto the surface of the sea, can be easily removed.

The structure shown in FIG. 3 includes a vertically disposed fin-like member 58 integrally attached to the exterior surface of the shell 20 to provide a preselected orientation of the shell 20 relative to the direction of movement of the waves. The sides of the fin-like member 58 are continuously subjected to wave radiation pressure. When this wave radiation pressure is balanced, the member 58 is located leeward of the shell 20 in alignment with arrow A, thus providing a preselected orientation of the shell 20. If the wave radiation pressure on each side of the fin-like member 58 becomes unbalanced, the fin-like member 58 automatically moves until the wave radiation pressure is balanced. This movement pivots the shell 20 about tether line 50. Therefore, the structure shown in FIG. 3 constantly senses the wave direction and maintains itself correctly aligned with respect thereto to face a particular flow of material and extract it from the surface of the water. The upper surface of the fin-like member 58 will normally be flat and can function to support walkway 54. The outermost edge of the fin-like member 58 functions as a mooring station for ship 56. The access pipe 50 extends through the fin-like member 58 into the shell 20 and, as before, is closed by cover 52 and accessible from the walkway 54.

Figure 4:
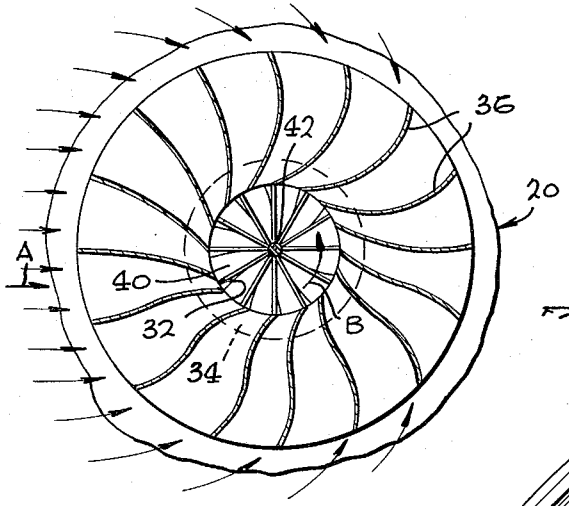
FIG. 4 is a top plan view of non-symmetrical inlet guide vanes used to tangentially direct water into the apparatus of the present invention.

Were it desired to extract energy from the apparatus, the inlet guide vanes 36 would be configured as in FIG. 4 so that they would channel water tangentially into the inlet opening 30, with the water rotating in the direction of arrow B in FIG. 4 and creating a vortex in the passage 32. In this case, the turbine 40 coupled to the shaft 42 and the load device or generator 44 would serve to extract the swirl energy and convert it into power, while the diffuser 46 would discharge the floating material into the chamber 22 under the shell 20. In addition, the nonsymmetrical guide vanes 36 would function to more efficiently ingest or extract the floating material.

Having described the invention, it is obvious that numerous modifications and departures may be made by those skilled in the art. For example, entrained solid material could be collected at the bottom of the standpipe by a sieve-like structure coupled to the standpipe or the diffuser and removed from beneath the bottom edge of the shell. Thus, the invention is to be construed as being limited only by the spirit and scope of the appended claims.

Industrial Applicability

The invention is useful in the extraction of floating salvageable material and discardable material from the sea.

I claim:

1. Apparatus for extracting material floating on the surface of a fluid, said surface having waves moving thereon, said apparatus comprising:

(a) generally dome-like shell for causing said waves to break, said shell being configured to refract said waves so that the waves after breaking flow along said shell toward a central opening at its apex;

(b) guide vanes secured to said shell for directing said breaking waves into said central opening to induce a downward vortical flow of surface fluid and said material through said central opening;

(c) a standpipe having an inlet end and an outlet end, the inlet end being attached to said shell circumjacent said central opening, the outlet end extending into a region beneath said shell into which said downward flow of fluid and said material is discharged so that said material rises to the top of the fluid beneath said shell, said shell thereby accumulating said material extracted from the surface of said fluid;

(d) diffuser means coupled to said outlet end of said standpipe for diffusing said fluid and said material discharged from said standpipe into said region beneath said shell;

(e) tethering means for securing said shell in a partially submerged position with respect to said fluid surface, said tethering means having one end secured to said diffuser means and the other end securable to a stationary object beneath the surface of said fluid thereby permitting random orientation of said shell;

(f) fin means secured to said shell for providing a selected orientation for said shell with respect to the movement of said waves on the surface of said fluid; and (g) means providing access through said shell to said region beneath said shell to permit removal of accumulated material from beneath said shell.

2. An apparatus for extracting material from the surface of a liquid medium, said apparatus comprising:

(a) impedance transformation means having an upwardly convex configuration for receiving surface waves on said liquid medium, said surface waves being at least partly comprised of potential energy, and for converting said potential energy to kinetic energy;

(b) inertial means having an input coupled to said impedance transformation means for receiving and temporarily storing said kinetic energy, and having an output from which continuous gradual withdrawal of said kinetic energy is obtained;

(c) diffuser means for discharging the liquid medium in which said surface waves are propagated and said material carried by said liquid medium, said liquid medium and material being discharged beneath said impedance transformation means after having passed through said apparatus;

(d) tethering means for securing said impedance transformation means in a partially submerged position with respect to said liquid medium, said tethering means permitting random orientation of said impedance transformation means;

(e) fin means secured to said impedance transformation means for providing a selected orientation of said impedance transformation means with respect to said surface waves; and (f) means providing access through said impedance transformation means to enable said material to be removed from beneath said impedance transformation means.

* * * * *